US008853511B2

(12) United States Patent
DePue, Jr.

(10) Patent No.: US 8,853,511 B2
(45) Date of Patent: Oct. 7, 2014

(54) PERCUSSIVE BLOCK FOR MUSICAL INSTRUMENTS

(71) Applicant: Wallace Earl DePue, Jr., Philadelphia, PA (US)

(72) Inventor: Wallace Earl DePue, Jr., Philadelphia, PA (US)

( * ) Notice: Subject to any disclaimer, the term of this patent is extended or adjusted under 35 U.S.C. 154(b) by 19 days.

(21) Appl. No.: 13/849,021

(22) Filed: Mar. 22, 2013

(65) Prior Publication Data

US 2013/0276612 A1 Oct. 24, 2013

Related U.S. Application Data

(60) Provisional application No. 61/617,429, filed on Mar. 29, 2012.

(51) Int. Cl.
*G10D 1/02* (2006.01)
*G10D 3/00* (2006.01)

(52) U.S. Cl.
CPC ..... *G10D 3/00* (2013.01)
USPC ..... 84/274; 84/294; 84/402

(58) Field of Classification Search
USPC ..... 84/274, 294, 402
See application file for complete search history.

(56) References Cited

U.S. PATENT DOCUMENTS

| | | | | | |
|---|---|---|---|---|---|
| 398,176 | A * | 2/1889 | Oerlein | 84/290 |
| 1,346,013 | A * | 7/1920 | Galbraith | 84/294 |
| 1,798,048 | A * | 3/1931 | Ungrich | 84/294 |
| 2,033,826 | A * | 3/1936 | Haium | 84/173 |
| 3,375,747 | A * | 4/1968 | Posey | 84/453 |
| 3,680,423 | A * | 8/1972 | Lander | 84/170 |
| 5,095,799 | A * | 3/1992 | Wallace et al. | 84/609 |
| 5,403,972 | A * | 4/1995 | Valentine, Sr. | 84/730 |
| 6,156,960 | A * | 12/2000 | Abrams | 84/269 |
| 6,369,304 | B1 * | 4/2002 | Tucker | 84/291 |
| 6,441,293 | B1 * | 8/2002 | LaBarbera | 84/723 |
| 6,696,632 | B2 * | 2/2004 | Minakuchi et al. | 84/735 |
| 7,622,662 | B2 * | 11/2009 | Shaper et al. | 84/267 |
| 8,614,383 | B1 * | 12/2013 | Palais | 84/294 |
| 2008/0066607 | A1 * | 3/2008 | Stannard | 84/402 |
| 2013/0228060 | A1 * | 9/2013 | Linden et al. | 84/267 |
| 2013/0276612 | A1 * | 10/2013 | Depue, Jr. | 84/290 |

* cited by examiner

*Primary Examiner* — Robert W Horn
(74) *Attorney, Agent, or Firm* — Ked & Associates LLP

(57) ABSTRACT

A percussion attachment for a musical instrument. The attachment includes a body having at least one aerating hole formed therein. A clamp is mounted to the body that attaches the body to the musical instrument. The body may be struck and/or scraped by the stick of a bow to produce percussion as well as functioning simultaneously as a protector as the musical instrument is being played. The body may include ribs that are spaced along an outermost curved edge of the body such that contacting the ribs with the stick of a bow to produce a percussion sound. The body may also include pits spaced on a top surface of the body such that contacting the pits with the stick of a bow to produce a percussion sound.

15 Claims, 10 Drawing Sheets

PERCUSSIVE BLOCK FOR MUSICAL INSTRUMENTS

CROSS-REFERENCE TO RELATED APPLICATIONS

This application claims priority to U.S. Provisional Patent Application 61/617,429 filed on Mar. 29, 2012.

STATEMENT REGARDING FEDERALLY SPONSORED RESEARCH OR DEVELOPMENT

The present invention was not developed with the use of any Federal Funds, but was developed independently by the inventor.

BACKGROUND OF THE INVENTION

1. Field of the Invention

This invention relates specifically to a rhythm beating attachment for use with bowed stringed instruments, both acoustic and electric, such as a violin, viola, cello, double bass, and the like encompassing all sizes thereof, including fractional sizes (i.e., 1/64th size to 4/4size). The present invention offers the opportunity for the musician to manually produce percussive sounds with the stick of the bow while simultaneously playing a bowed stringed instrument, both acoustic and electric, without the risk of damaging the cosmetic appearance and/or structural integrity of the instrument. In use, the instrumentalist is capable of manually producing percussive sounds by his own unique and intricate technical manipulations of the bow by intentionally striking and/or scraping the percussion device with the stick of the bow. The instrumentalist does not produce percussion by triggering an actuation device or any other mechanical or electrical impulse, initiated by the instrument player, as is known.

2. Description of the Related Art

A growing trend of bowed stringed instrument performers, especially in the field of Avant-garde music as well as in jazz, country, pop and rock-n-roll, is to strike and/or scrape the body of the instrument with the stick of the bow in order to add percussion to their music, such as during rehearsals, recordings, and performances. However, this striking and scraping of the instrument with the stick of the bow has proven to be severely damaging to the cosmetic beauty and structural integrity of the instrument to the point where the instrument can become unplayable. Therefore, the two primary objects of the present invention are to provide a percussion addition that is easily adapted to solid or hollow bodied bowed stringed instruments that will 1. Produce acoustically enhanced percussive sounds, preferably wooden block and rasping sounds, when intentionally struck and/or scraped by the stick of the bow; and 2. Provide ample protection of the body of the instrument in the regional area where the bow is most easily manipulated by the instrumentalist to strike and/or scrape the instrument; that area being located specifically at the upper left bout region of the violin and viola and the upper right bout region of the cello and double bass. These two primary objects are inseparable in that the intended functions are of equal importance.

While the benefit of adding percussion sounds to bowed stringed instruments has been known for many years with the use of pizzicato, pizzicato string slapping, hand string slapping, colegno, string chopping and knocking the back of the instrument with human knuckles, the prior art does not disclose an apparatus that is easily attached to bowed stringed instruments which is intended and specifically designed to be struck and/or scraped with the stick of a bow by the player to produce several different types of percussive sounds.

SUMMARY

A percussion attachment for a musical instrument. The attachment includes a body having at least one aerating hole formed therein. A clamp is mounted to the body that attaches the body to the musical instrument. The body may be struck and/or scraped by the stick of a bow to produce percussion as well as functioning simultaneously as a protector as the musical instrument is being played. The body may include ribs that are spaced along an outermost curved edge of the body such that contacting the ribs with the stick of a bow to produce a percussion sound. The body may also include pits spaced on a top surface of the body such that contacting the pits with the stick of a bow to produce a percussion sound.

The body may have an outer top surface that has a convex shape. In one form of the invention, the top surface has a hump formed at either end. The body may include ornamentation. The body may be made from wood, metal, plastic or the like.

The clamp may be a pair of Hill-style clamps. The clamp may detachably secure the attachment to the musical instrument.

In one form of the invention, the body has a carved-out incrementally sloped design that is acoustically designed to produce enhanced and amplified percussive sounds when struck and/or scraped with the stick of the bow.

BRIEF DESCRIPTION OF THE SEVERAL VIEWS OF THE DRAWINGS

The following detailed description of the invention will be better understood when read in conjunction with the appended drawings. For the purpose of illustrating the invention, there are shown in the drawings embodiments that are presently preferred. It should be understood, however, that the invention is not limited to the precise arrangements and instrumentalities shown.

In the drawings.

DETAILED DESCRIPTION OF THE INVENTION

Figure 1:
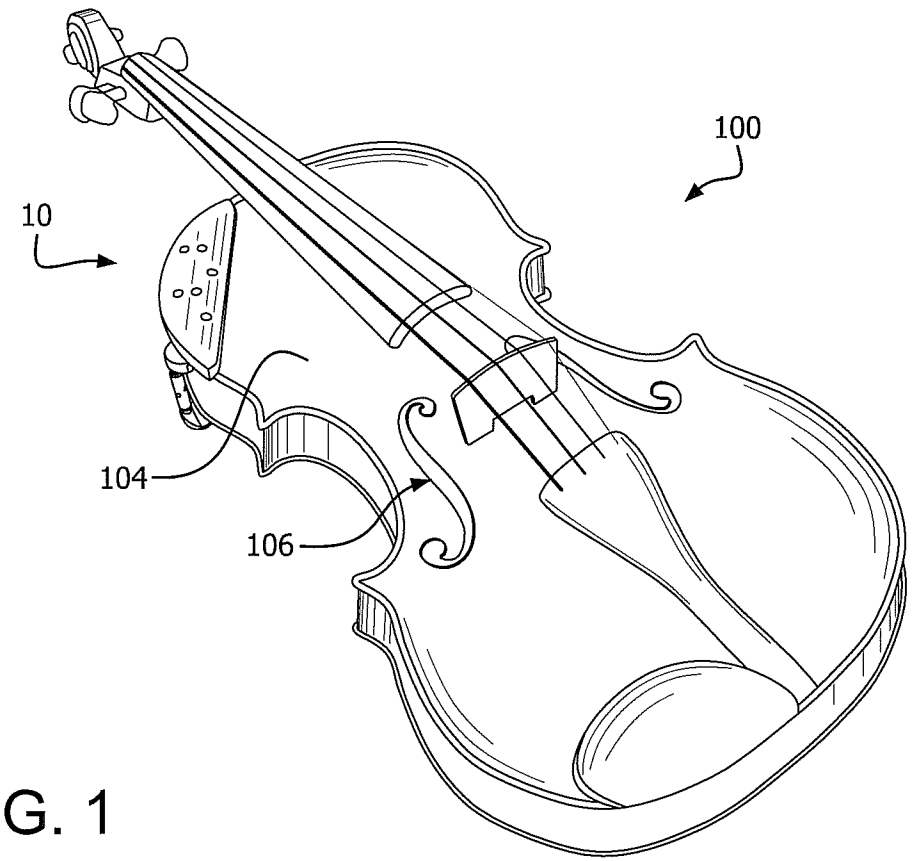
FIG. 1 is a front perspective view of a Rhythm Beating Attachment according to a first embodiment of the present invention.

References will now be made in detail to the preferred embodiments of the invention, examples of which are illustrated in the accompanying drawings. Wherever possible, the same reference numerals will be used throughout the drawings to refer to same or like parts.

Figure 10:
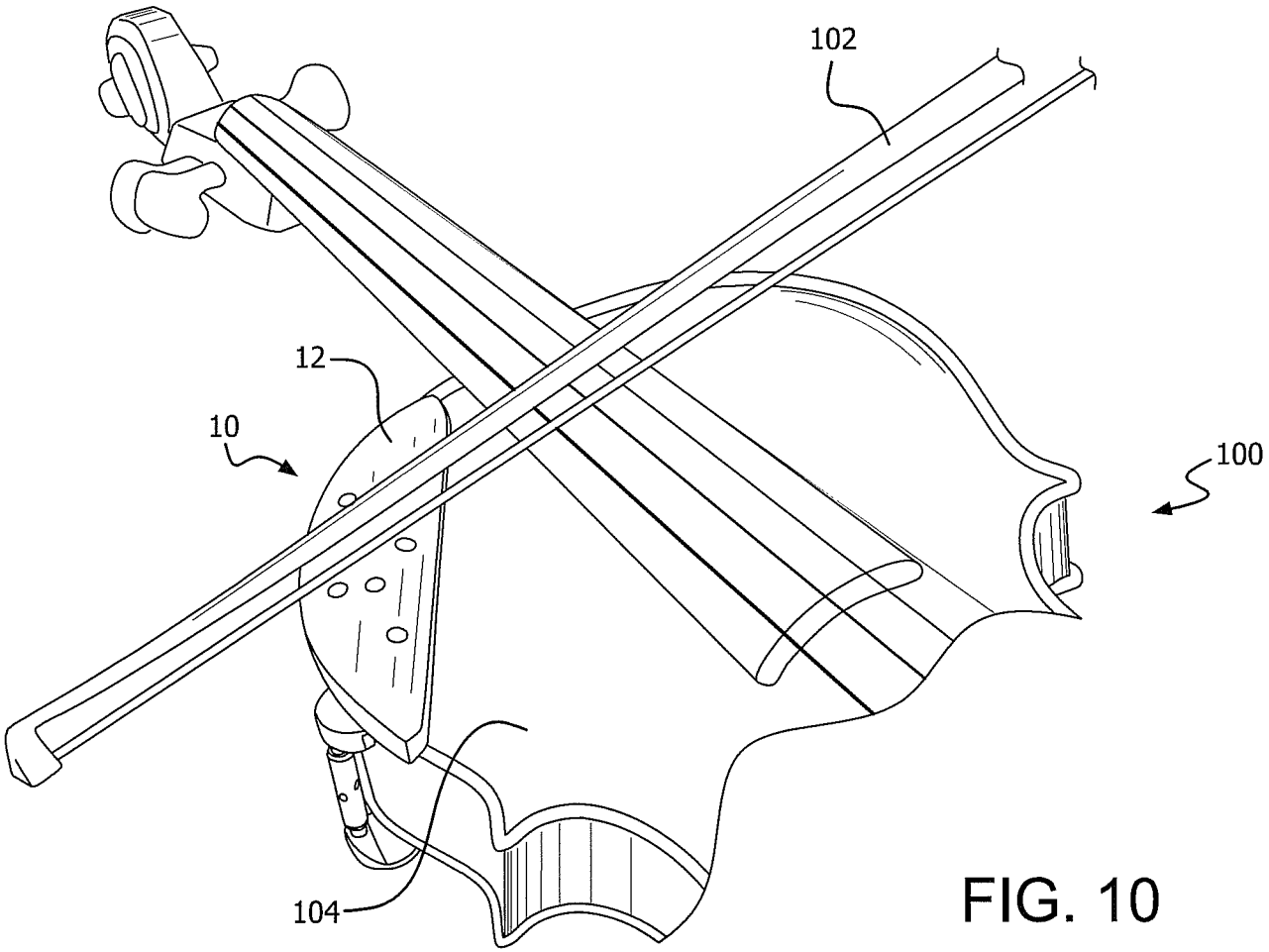
FIG. 10 is partial front view of the Rhythm Beating Attachment of FIG. 1 shown in use.

Referring now to FIGS. 1 and 10, the present invention relates to a novel and useful rhythm beating attachment 10 for instruments such as a violin 100, and method for using the same, to be struck and/or scraped by the stick of a bow 102 (see FIG. 10) to produce percussion as well as functioning simultaneously as a protective device for the violin 100 and other bowed stringed instruments such as a viola, cello, double bass, and the like. As used herein, the term "beating" is intended to collectively encompass striking, scraping, and other actions that generate a percussion sound.

One function of the present invention relates to a percussion attachment 10 that is specifically designed to be intentionally struck by the stick of the bow 102 in order to simultaneously produce percussive sounds while the violin, viola, cello or double bass is being played upon by an instrumentalist in a traditional manner. Another function of the present attachment 10 is as a protector that shields the bow 102 from striking the edge of the bowed stringed instrument 100 in the upper left bout region 104 of the violin and viola and upper right bout region (not shown) for cello and double bass, substantially eliminating potential damage to the instrument 100 such as cracks, wood splinters, nicks, dents, and scratches and the like due to repeated light-to hard and slow-to-fast intentional bow stick strikes and bow stick scrapes.

Referring now to FIGS. 1-8 and 10, the percussion attachment 10 comprises a body 12 having a half oval-shape constructed and arranged to be detachably secured by at least one clamp 14, such as Hill-style chinrest clamp, to the upper left bout portion 104 of the instrument 100, such as a violin or viola sound box, or upper right bout for cello and double bass sound box (not shown). In the embodiment shown, two clamps 14 are provided. The body 12 may be fabricated from any suitable rigid, yet durable material such as, but not limited to, wood, plastic, metal or any other combination of synthetic and/or natural materials that will be sufficiently strong enough to withstand intentional strikes and/or scrapes by the instrumentalist with the stick of a bow 102.

One object of the present invention is to provide a percussion attachment 10, which will conform to the conventional forms of manufacture of acoustic and electric bowed stringed instruments, specifically the curvature of the upper left bout 104 of a violin and viola, and specifically the curvature of the upper right bout (not shown) of a cello and double bass. However, there are exceptions to the conventional forms of manufacture of acoustic and electric bowed stringed instruments, which may necessitate a custom shape modification of the percussion attachment 10 in order to properly fit the unique upper bout curvature of a specific instrument.

It is another object of the present invention that the body 12 may be fabricated from unique and various grades of handmade construction that will provide several different price points of economic affordability. Numerous colors of wood stain, numerous types of polishing, numerous types of hard woods, different types of polyurethane such as satin, semi-gloss, clear gloss, and different types and colors of metal hardware used for the Hill style clamps 14 such as nickel-silver, nickel imitation gold, titanium, and anodized aluminum all help in providing several different price points of affordability. Along with this, certain ornamentation details in decoration and/or construction, such as engravings (not shown), may be added at the musician's request so long as the additions do not negatively compromise the overall design and structural integrity of the percussion attachment 10. By including these optional ornamentations, the attachment 10 becomes personally unique to the musician who requests such additions. This, in turn, can protect the attachment 10 from being generically mass-produced so that any "knock-offs" will be aesthetically less desirable in the musical instrument market. The goal aesthetically and utility-wise is to conceive the attachment 10 as a musical instrument with artistic merit and beauty, added to a bowed stringed instrument 100 that historically demands a high level of artistic merit and beauty in its own construction.

It is another object of the present invention to provide a percussion attachment 10 meant to be struck and/or scraped by a bow 102, which is easily attached to a bowed stringed instrument 100 in such a manner as to utilize the acoustical characteristics of the instrument 100 to which it is attached. This is especially true for hollow acoustic bowed stringed instruments. Since the attachment 10 is attached directly to the hollow sound chamber of the acoustic bowed stringed instrument 100, when the attachment 10 is struck with the stick of the bow 102, the percussive sounds of the attachment 10 are enhanced or amplified by the natural acoustical attributes of the acoustic instrument itself in part, utilizing the f-holes 106 of the instrument 100 from which the percussive sounds are released.

It is another object of the present invention to provide a musical accompaniment attachment 10, which allows a musician to accompany his/her own playing of a bowed stringed instrument 100 with percussion.

Accordingly, it is an object of the present invention to provide a musical accompaniment attachment 10, which produces percussion manually by the instrumentalist while in simultaneous use with the bowed stringed instrument 100.

It is another object of the present invention to provide a percussion attachment 10 intended to be struck and/or scraped with the stick of a bow 102 that is slim in dimensions so that the attachment 10 may remain attached to the bowed stringed instrument 100 when the instrument is placed into its protective carrying case (not shown), which is typically form-fitting.

It is another object of the present invention to provide a percussion attachment 10 intended to be struck and/or scraped with the stick of a bow 102 that is slim in dimensions so that when the attachment 10 is detached from the bowed stringed instrument 100, the attachment 10 can easily be stored inside the instrument's protective carrying case (not shown) along with and close to the instrument 100.

It is another object of the present invention to provide a percussion attachment 10 intended to be struck and/or scraped with the stick of a bow 102 that is insignificant in weight so that while the attachment 10 is attached to the bowed stringed instrument 100, the instrumentalist does not become overly fatigued while practicing and/or performing on the instrument in playing position.

It is another object of the present invention to provide a percussion attachment 10 intended to be struck and/or scraped with the stick of a bow 102 that is acoustically designed to produce enhanced percussive sounds out and of the attachment 10 itself. As described above, when the attachment 10 is struck and/or scraped with a bow 102 while the attachment 10 is attached to the hollow sound chamber of the acoustic bowed stringed instrument 100, the percussive sounds produced are, in part, enhanced or amplified by the natural acoustical attributes of the instrument itself, utilizing the f-holes 106 of the instrument 100 from which the percussive sounds are released. However, in addition to the enhanced percussive sounds released from the instrument 100, the percussion attachment 10 alone is acoustically designed to produce enhanced and amplified percussive sounds when struck and/or scraped with the stick of the bow 102. As best seen in FIGS. 2-8, the underbelly 18 of the percussion attachment 10 is carved out in incrementally sloped thicknesses in the general shape of a spade shovel by use of a chiseling process. Beginning at its narrowest and shallow most point at approximately 5 millimeters from the curved back edge 20 of the attachment 10, the hollowed-out underbelly 18 gradually slopes into a spade shape, gradually widening and deepening towards the front straight edge 22 of the percussion attachment 10. Once the gradual carved out sloping and hollowed widening of the underbelly 18 reaches the front edge 22 of the percussion attachment 10, the resulting shape of the front edge 22 of the device culminates into an elongated, slight convex arch.

Figure 4:
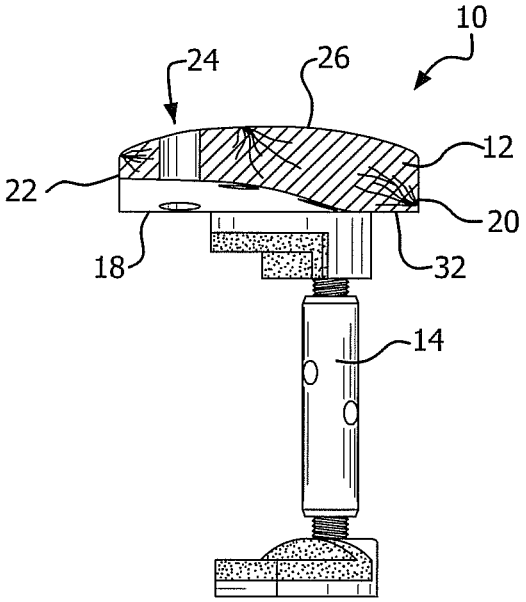
FIG. 4 is a cross-section view of the Rhythm Beating Attachment of FIG. 1 taken along line 4-4.
Figure 9:
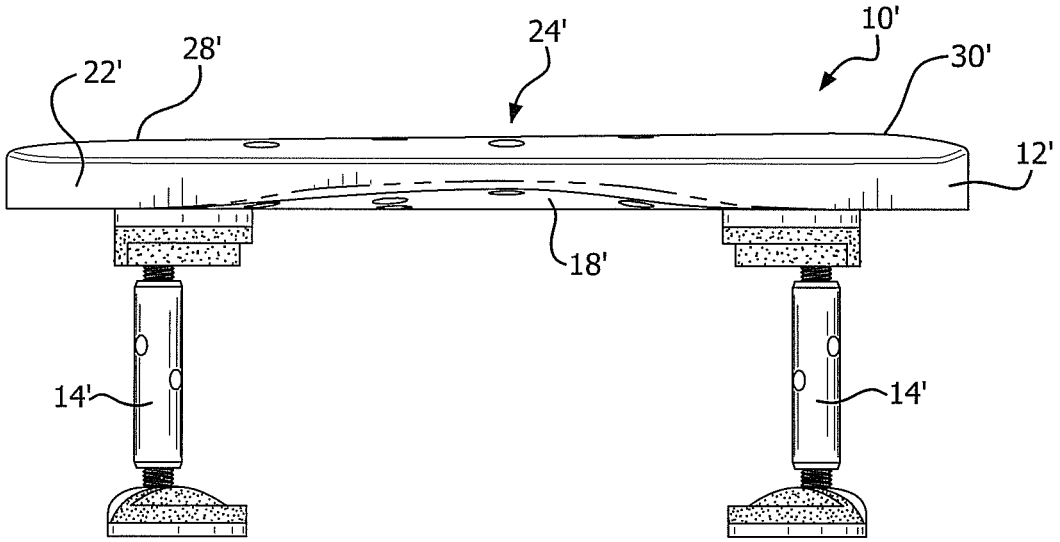
FIG. 9 is front view of a second embodiment of the Rhythm Beating Attachment.
Figure 5:
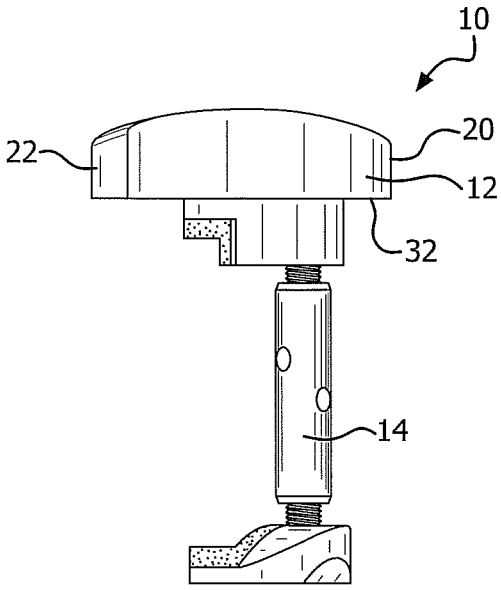
FIG. 5 is a right side view of the Rhythm Beating Attachment of FIG. 1.
Figure 6:
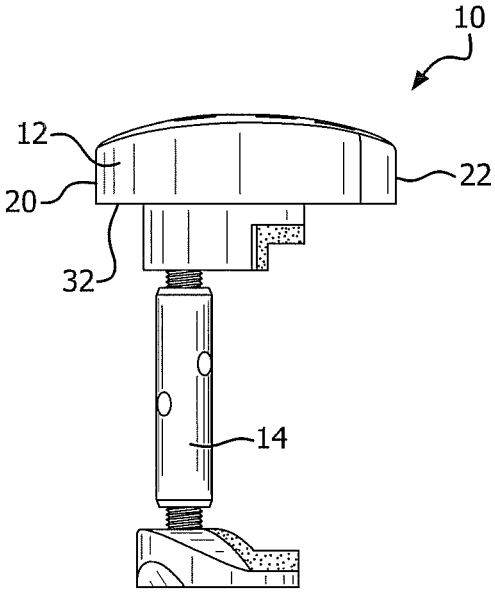
FIG. 6 is left side view of the Rhythm Beating Attachment of FIG. 1.

Accordingly, an embodiment of the percussion attachment 10 that should have the freedom to fluctuate related to design at the discretion of the maker, is the length and height of the convex arch viewed from the front edge 22 of the percussion attachment 10. The fluctuations in length and height of the convex arch, as best seen in FIG. 4, directly influences the hollowed-out underbelly surface 18 of the percussion attachment 10. The higher and/or longer the front edge convex arch is, the more hollowed out the underbelly surface 18 becomes, both in overall carved-out mass area as well as in overall thicknesses. The reasons for these aforementioned fluctuations, is to accommodate the proper acoustics related to the type and/or density of the wood used in the overall construction of the percussion attachment 10. For example, FIG. 9 shows an embodiment in which a different species of wood, such as ebony wood rather than maple wood, plastic, or metal is used in the construction of the percussion attachment 10'. The recommended height and/or length of the front edge convex arch 22' should generally be longer and higher and the underbelly surface 18' should be hollowed-out slightly more in order to optimize sound production of the percussion attachment, since ebony wood is a denser and heavier wood than maple wood. In general, a heavier, denser wood type, such as ebony, is structurally stronger on a molecular level than maple wood, which in turn, allows for the underbelly 18 of the percussion attachment 10 to be hollowed out to thinner dimensions in order to achieve optimal sound without negatively compromising the structural integrity and durability of the percussion attachment 10. Similarly, a percussion attachment 10 which is fabricated from hard plastic or steel metal will allow for the underbelly 18 to be hollowed out to even thinner dimensions than would be appropriate for the underbelly of a percussion attachment 10 made from ebony wood.

Figure 7:
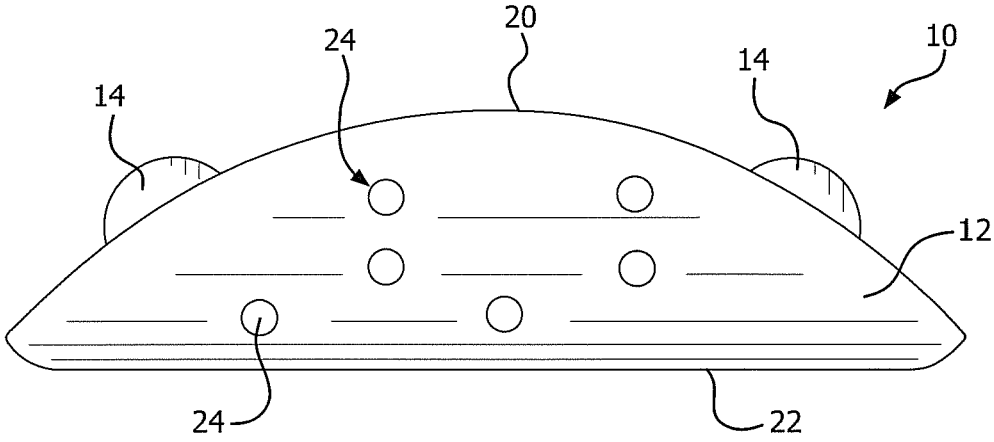
FIG. 7 is a top view of the Rhythm Beating Attachment of FIG. 1.
Figure 8:
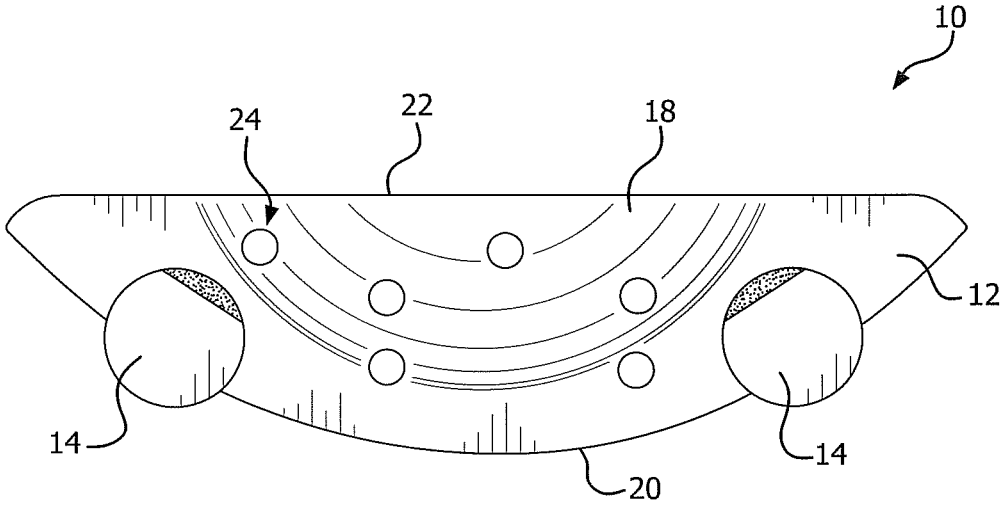
FIG. 8 is bottom view of the Rhythm Beating Attachment of FIG. 1.

In addition to the hollowed out design of the underbelly 18 of the percussion attachment 10, there are provided aerating sound holes 24 which are formed in and pass completely through the body 12 of the attachment 10, such as by a drilling process. In the embodiment shown, six aerating holes 24 are provided. Since the primary conductor of sound waves is air, these aerating sound holes 24 enable air to circulate underneath and through the percussion attachment 10. When the percussion attachment 10 is struck and/or scraped with the stick of the bow 102, the resulting percussive sound waves produced is circulated via air through the sound holes 24 through the body 12 of the attachment 10. In one preferred embodiment, the standard pattern of the six aerating holes drilled through the body of the percussion attachment 10 is of two capital "Bs" used in the Braille alphabet system as best seen in FIG. 7. It should be understood that other patterns and/or numbers of aerating holes 24 are suitable for use and fall within the scope of the invention.

Figure 2:
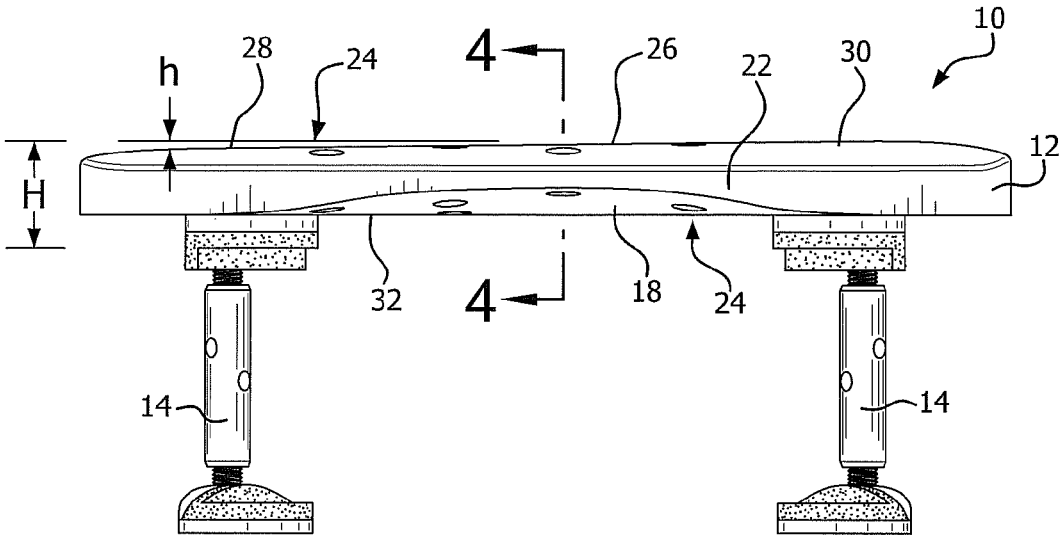
FIG. 2 is a front view of the Rhythm Beating Attachment of FIG. 1.

As best seen in FIGS. 2 and 4, it is another object of the present invention to provide an overall slight convex shape 26 of the outer surface of the top of the percussion attachment 10 running the entire length of the attachment 10 from top to bottom so that this convex form 26 significantly eliminates the risk of breaking the stick of the bow 102 when the bow is intentionally struck and/or scraped against the attachment 10. As a result of this convex form 26 of the top outer surface, there are no sharp edges on the percussion attachment 10 that may cause the stick of the bow 102 to break when the bow is intentionally struck and/or scraped against the attachment 10.

The attachment 10 is intended for being struck with synthetic types of bow sticks such as fiberglass, carbon fiber, and metal bow sticks or the like. Glasser Bows makes different quality grades of bowed stringed instrument bows out of bow sticks that are made of a very durable fiberglass material that will endure the rhythmic rigors of striking and/or scraping the percussion attachment 10. Carbon fiber bow making companies, such as Arcos Brasil Carbon Bows and CodaBow, as well, make different quality grades of carbon fiber bows for bowed stringed instruments that will endure the same. Nowadays, synthetic types of stringed instrument bows are not only very strong and durable, but most are great playing bows as well, used more and more by outstanding professionals in the field of bowed stringed instrument performance.

It is another object of the present invention to provide an asymmetric two-hump design of the outer curved back face 20 of the percussion attachment 10 to enable the instrumentalist to perform rapid, multiple bow stick ricochets with the reduced risk of the bow stick 102 falling off of the convex outer top surface 26 of the attachment 10 resulting in missing the desired rapid rhythmic effect intended by the instrumentalist. When viewing the percussion attachment 10 from the curved back face 20, one will notice a short hump 28, approximately eight (8) millimeters in thickness at its highest peak, formed at the bottom of the back face 20 of the attachment 10, followed by a longer, higher hump 30, approximately nine (9) millimeters in thickness at its highest peak, at the top of the back face 20 of the attachment 10. The distance h represents the difference in thickness between the top hump 30 and the bottom hump 28. It is suggested that the instrumentalist should accurately execute the initial strike of the bow 102 at the peak of the shorter, bottom hump 28 to get the momentum of the bow stick ricochet started, ricocheting into the longer, top hump 30 which provides a gradual stoppage of the ricochet in order to keep the stick of the bow 102 from falling uncontrollably off of the convex outer top surface 26 of the percussion attachment 10. This two-hump design is important in the structural construction of the percussion attachment 10 in order to facilitate better controlled ricochets of the bow stick 102 manually performed by the instrumentalist, either by a striking action and/or a scraping action. The desired number and/or speed of the percussive bow stick-ricochets are left up to the discretion of the composer of a given composition, and/or to the improvisational intentions of the instrumentalist.

As best seen in FIG. 2, it is another object of the present invention to provide an approximate equal height H of the percussion attachment 10 to that of the height of the fingerboard of a bowed stringed instrument 100 observed on a violin, viola, cello, and double bass so that the strings situated directly above the fingerboard of the mentioned instruments can be struck with the bow stick 102 simultaneously with the percussion attachment 10, resulting in a very elastic, bouncing effect of the bow stick 102 while it strikes the percussion attachment 10. Striking the percussion attachment 10 simultaneously with the strings also produces a pitched, metallic percussive sound quality uniquely available to bowed stringed instrumentalists utilizing the attachment 10 of the present invention. As best seen in FIG. 2, the overall height H of the body of the percussion attachment 10 when mounted to the bowed stringed instrument 100 is measured from bottom, where the top of the two Hill style clamps 14 rest on top of the upper left bout edge of the instrument 100, up to the convex outer top surface 26 of the percussion attachment 10. It is the intention of the inventor to keep the overall height of the body 12 of the percussion attachment 10 low in stature in order to correlate to the general heights of bowed stringed instrument fingerboards, so that the instrumentalist more easily performs ricocheting and other technical manipulations of the bow.

Figure 11:
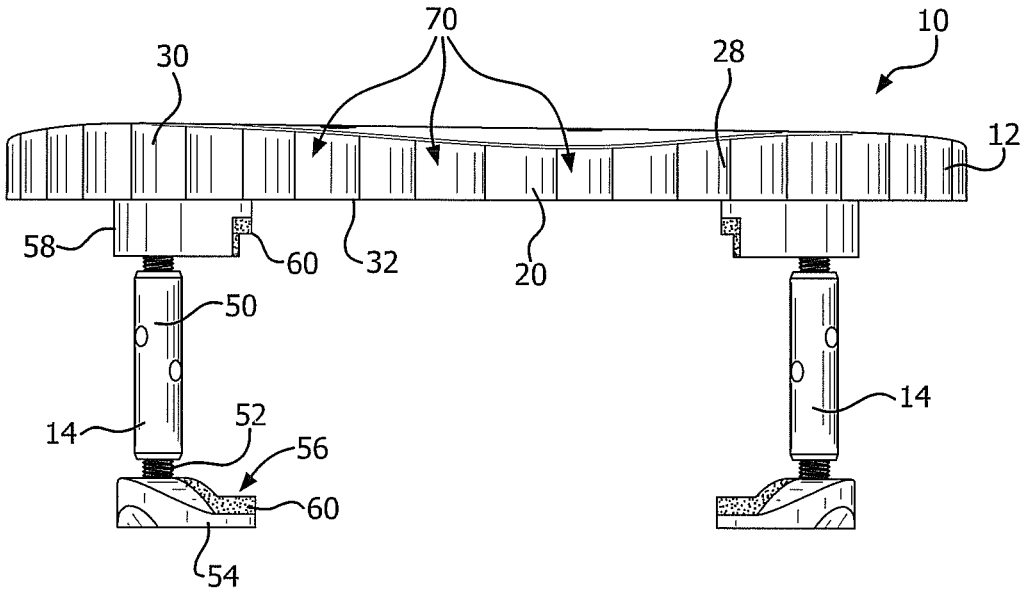
FIG. 11 is a rear view of a second embodiment of a third embodiment of Rhythm Beating Attachment.
Figure 12:
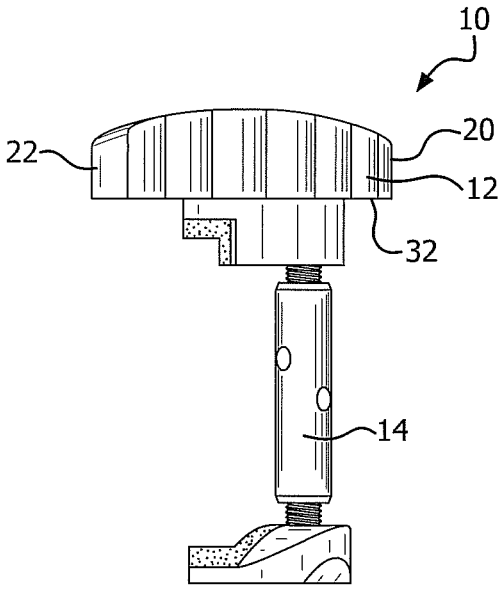
FIG. 12 is a right side view of the Rhythm Beating Attachment of FIG. 11.
Figure 13:
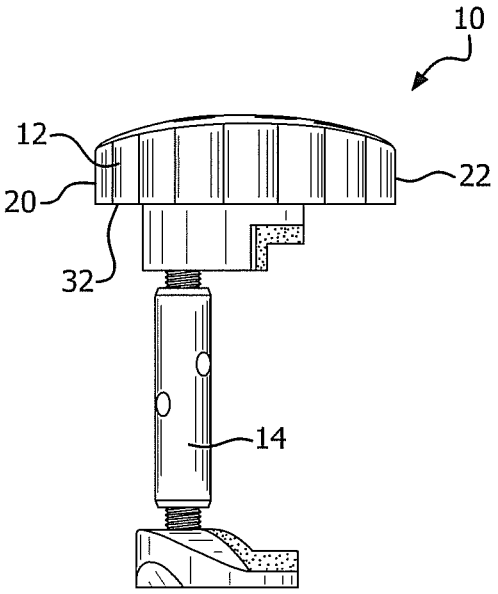
FIG. 13 is left side view of the Rhythm Beating Attachment of FIG. 11.

Referring now to FIGS. 11-13, it is another object of the present invention to provide a percussion attachment 10 for a bowed stringed instrument that has a plurality of carved out ribbed areas 70 which can provide the instrumentalist to technically execute short to sustained percussive rasping sounds with the stick of the bow at a double loud level of volume, known in music theory as fortissimo (ff).

Figure 14:
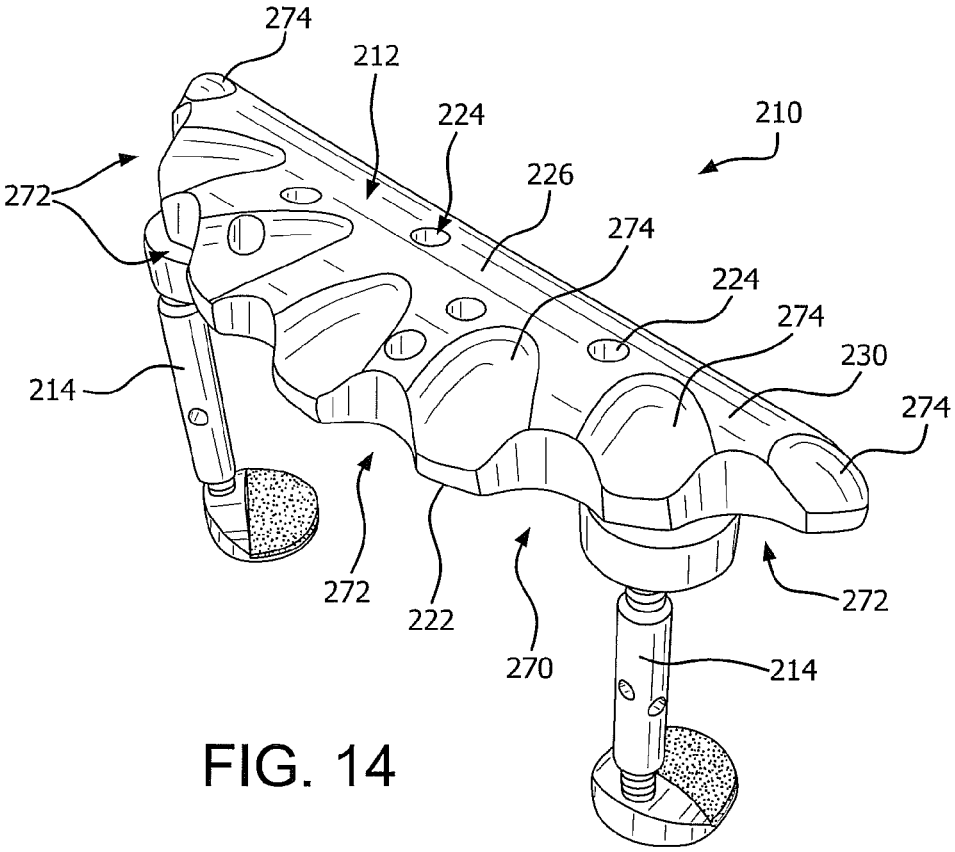
FIG. 14 is a top perspective view of a fourth embodiment of a Rhythm Beating Attachment.
Figure 15:
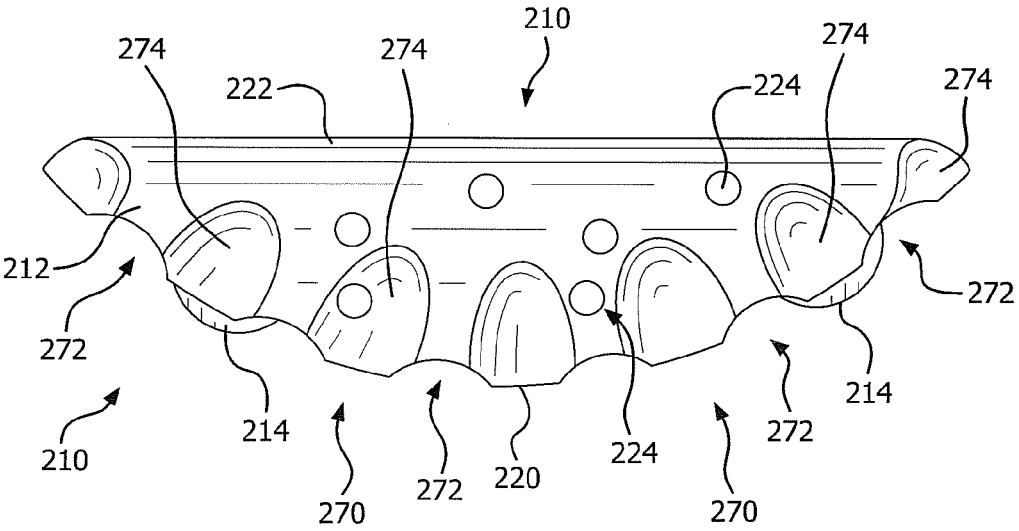
FIG. 15 is a top view of the Rhythm Beating Attachment of FIG. 14.
Figure 16:
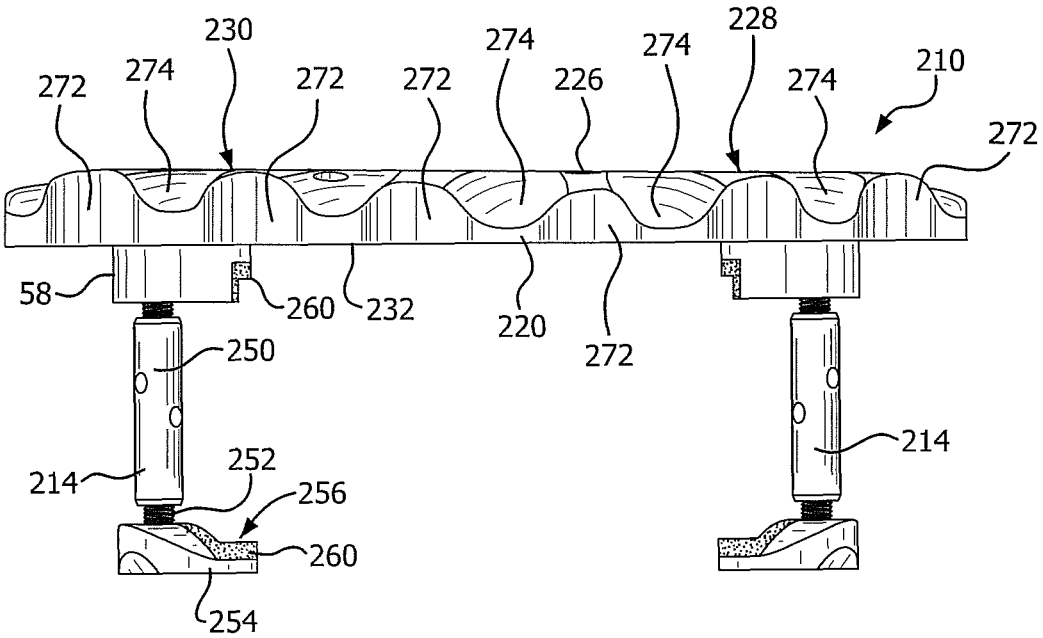
FIG. 16 is a rear view of the Rhythm Beating Attachment of FIG. 14.

Referring now to FIGS. 14-16, the ribbed area 270 is located along the entire length of the outer most curved edge 222 of the percussion attachment. There are a total of six (6), crescent moon-shaped ribs 272 that are formed along the outermost curved edge of the percussion attachment 210. Preferably, each rib 272 is carved out to a total width of approximately 10 millimeters, and carved approximately three (3) millimeters in depth, beginning from the outer curved edge 222 into the body 212 of the percussion attachment 210. Each rib is carved and shaped into the outer edge of the percussion attachment 210 by using a chiseling process. Each crescent moon-shaped rib 272 is spaced approximately ten (10) millimeters apart from one another as well.

When the instrumentalist repeatedly executes a continuous up and down scraping motion of the bow stick over this outer edged ribbed area 272 of the percussion attachment 210, the percussive sound effect produced is a sustained, fortissimo (ff) rasping sound, similar to the sustained rasping sound produced when a wooden stick is repeatedly and continuously scraped up and down over the ribs of a Latin percussion instrument traditionally referred to as the 'guiro'(Spanish: for 'gourd'). In contrast, the instrumentalist can also produce shorter, staccato rasping sounds with the stick of the bow by executing separate, shorter and faster scraping manipulations of the bow stick over the ribbed area and/or scraping the bow over five or less crescent moon-shaped ribs 272 of the percussion attachment 210. It should be understood that other patterns and/or numbers of ribs 272 along the outermost curved edge 222 of the percussion attachment 210 are suitable for use and fall within the scope of the invention. It should also be understood that other carved depths and/or other measurable widths of each individual rib 272 is suitable and fall within the scope of the invention. For example, one rib, in whatever shape or pattern, may be 10 millimeters in width and 3 millimeters in depth while the adjacent rib, in whatever shape or pattern, may be 5 millimeters in width and 1 millimeter in depth, and both may occur on the same percussion attachment 10. It should also be understood that other measurements and/or dimensions, both symmetrical and asymmetrical, of the spaces in between each rib are suitable for use and fall within the scope of the invention.

It is another object of the present invention to provide a percussion attachment 210 for a bowed stringed instrument that has a pitted area specifically designed for the tapering shape of a bow stick which allows the instrumentalist to execute, through several different technical manipulations of the bow, short to sustained percussive rasping sounds at all different locations of the bow stick in order to manually produce and control several different levels of volume. The bow stick used by violinists, violists, cellists, and double bassists today all have one element in common with respect to the traditional design of the bow stick; that the stick shaft of the bow ranges from a thicker circumference at the frog (lower end) of the bow and gradually tapers off towards the head into a thinner circumference, the thinnest area located near the head (tip) of the bow stick. This has been the general design of bow sticks since circa the 1790s. In order to accommodate the gradual tapering design of the bow stick, seven (7) cone-shaped pits 274 are provided on the top surface of the percussion attachment 10, located and following along its outer most curved edge. Each pit 274 is carved and shaped into the top surface area 226 of the percussion attachment 210, preferably using a chiseling process.

Each individual pit 274 begins from the outer curved edge 222 and extends approximately 20 millimeters in length into the inner top surface of the percussion attachment 10, with the exception of the top and bottom pits at each lateral edge of the body 212 which extend approximately 10 millimeters from the outer curved edge 222 into the inner top surface 226. As aforementioned, each pit 274 has the general shape of a cone, each being approximately 10 millimeters in width at its widest point located along the outer curved edge of the percussion attachment 210, to approximately 2 millimeters wide at its narrowest point into the inner top surface 226.

The carved out sloping thicknesses of each cone-shaped pit 274 range from approximately 3 millimeters in depth into the top surface along the outer curved edge of the percussion attachment 10, to approximately 0.1 (one-tenth) millimeter in depth into the inner top surface. Each cone-shaped pit is spaced approximately ten (10) millimeters apart from one another as well. The primary reason for each pit 274 having the shape of a cone, each having a gradual narrow-to-wide feature, and each having a gradual shallow-to-deep carved out sloping depth, is to facilitate the gradual tapering of the circumference of the bow stick. This facilitation enables the instrumentalist to manipulate the natural tapering design of the bow stick to his/her advantage in combination with the gradual widening and sloping depths of the cone-shaped pits in order to manually control different levels of sustained volume of the percussive rasping sounds the percussion attachment 210 produces when the bow stick is scraped over the seven pits 274.

For example, if the instrumentalist desires to produce a sustained, continual rasping sound at a double soft volume such as pianissimo (pp), the best way to accomplish this effect would be to scrape the bow stick up and down continuously over the seven top surface pits 274 of the percussion attachment 210 at their narrowest and shallow most points in combination with the thinnest circumference area of the bow stick located near the head. In contrast, if the instrumentalist desires to produce a sustained, continual rasping sound at a loud volume such as forte (f), the best way to accomplish this effect would be to scrape the bow stick up and down continuously over the seven top surface pits 274 of the percussion attachment 210 at their widest and deepest points in combination with the thickest circumference area of the bow stick located near the frog. Below is a detailed description of how the different volume levels are achieved through different technical manipulations of the bow stick in combination with the seven cone-shaped pits 274 located on the top surface 226 of the percussion attachment 210. First, the terms used in traditional music theory of the various volume levels will be defined, followed by an explanation of how each volume level is manually achieved by the instrumentalist in performance practice through different manipulations of the bow stick used in combination with the percussion attachment 210.

1. Pianissimo (pp): Double-soft volume. Executed at the thinnest circumference area of the bow stick, located at the head (tip) of the bow, scraped over the narrowest and shallow most points of the seven cone-shaped pits 274 located into the inner most top surface of the percussion attachment 210.

2. Piano (p): Soft volume. Executed at a slightly thicker circumference area of the bow stick, located near the head of the bow, scraped over the relatively narrow and shallow contact points of the seven cone-shaped pits 274.

3. Mezzo-Piano (mp): Moderately soft volume. Executed at a slightly thicker circumference area of the bow stick, located approximately at the upper middle of the bow, scraped over the slightly deeper and wider contact points of the seven cone-shaped pits 274.

4. Mezzo-Forte (mf): Moderately loud volume. Executed at a moderately thick circumference area of the bow stick, located approximately at the middle of the bow, scraped over the middle contact points of the seven cone-shaped pits 274.

5. Forte (f): Loud volume. Executed at the thickest circumference area of the bow stick, located approximately at the lower half of the bow, scraped over the deepest and widest contact points of the seven cone-shaped pits 274 located at the outer most top surface edge of the percussion attachment 10.

6. Fortissimo (ff): Double loud volume. When the instrumentalist repeatedly executes a continuous up and down scraping motion of the bow stick over this outer edged ribbed area 272 of the percussion attachment 210, the percussive sound effect produced is a sustained, fortissimo (ff) rasping sound.

In addition, the instrumentalist can produce shorter, staccato rasping sounds at different levels of sustained volume using the same technical processes listed above; the only difference being that the instrumentalist executes separate, shorter and/or faster scraping manipulations of the bow stick over the pitted area and/or scraping the bow over six or less cone-shaped pits of the percussion attachment 210.

It should be understood that other carved depths and/or other measurable widths and lengths of each individual pit is suitable and fall within the scope of the invention. It should also be understood that other patterns and/or numbers of pits appearing on the top surface area of the percussion attachment 10 are suitable for use and fall within the scope of the invention. It should also be understood that other measurements and/or dimensions, both symmetrical and asymmetrical, of the spaces in between each pit located on the top surface of the percussion attachment 210 are suitable for use and fall within the scope of the invention.

It is another object of the present invention to provide a percussion attachment 210 for a bowed stringed instrument, which will enable an instrumentalist to produce short to sustained percussive rasping sounds with the stick of the bow and to manually control, at the same time, continual and gradual increments and decreases of volume from pianissimo (pp) to forte (f) and vice versa, known in music theory as crescendos and decrescendos respectively. For example, if a player desires to execute a crescendo of a sustained percussive rasping sound on the percussion attachment 210, going from pianissimo (pp) to forte (f), it is suggested that the instrumentalist begins this crescendo process by continually scraping the thinnest circumference area of the bow stick, located at the head of the bow, up and down over the narrowest and shallow most contact points of the seven cone-shaped pits 274. The instrumentalist can then move the bow in a gradual upwards motion from the head towards the frog while at the same time scraping the stick of the bow up and down over the seven cone-shaped pits. This upward motion of the bow allows for the gradual thicker circumference areas of the bow stick to scrape over the seven pits 274 which helps to gradually increase the volume of the percussive rasping sound. While the instrumentalist is executing a gradual upwards movement of the bow towards the frog, combined with continual up and down scraping, the instrumentalist should also begin to gradually angle the head of the bow downward towards the outer curved edge 222 of the percussion attachment 210 where the widest and deepest contact points of the seven cone-shaped pits 274 are located. The gradual angling of the head of the bow downward towards the outer curved edge 222 of the percussion attachment 210 allows for the bow stick to contact the seven cone-shaped pits 274 at incrementally deeper and wider points of the pits, which also helps to gradually increase the volume of the percussive rasping sound. Simplified, to produce a crescendo (pianissimo to forte) of the percussive rasping sound, the instrumentalist should: 1.) Begin the continual up and down scraping of the bow stick near the head over the seven cone-shaped pits 274 at their narrowest and shallow most contact points, and gradually move the bow upwards towards the frog. 2.) At the same time, gradually angle the head of the bow downward towards the outer curved edge 222 of the percussion attachment 210. To produce a decrescendo (forte to pianissimo), simply reverse the process: 1a.) Begin the continual up and down scraping of the bow stick near the frog over the seven cone-shaped pits 274 at their widest and deepest contact points, and gradually move the bow downwards towards the head. 2a.) At the same time, gradually angle the head of the bow upward towards the inner middle area of the top surface 222 of the percussion attachment 210. In addition, the instrumentalist can produce shorter, staccato rasping sounds utilizing crescendos and decrescendos by using the same technical processes listed above; the only difference being that the instrumentalist execute separate, shorter and/or faster scraping manipulations of the bow stick over the pitted area and/or scraping the bow over six or less cone-shaped pits 272 of the percussion attachment 210.

Referring back now to FIGS. 1-9, it is another object of the present invention to provide a percussion attachment 10 for a bowed stringed instrument 100, which is situated in an area of the instrument that is non-intrusive to the traditional technical functions of the instrumentalist's left hand. Due to the slim dimensions of the percussion attachment 10 and because it is attached to the upper left bout area 104 for the violin and viola, and attached to the upper right bout area (not shown) for a cello and double bass, the attachment 10 is intentionally designed in such a manner that it does not hinder, block, or obstruct in any way the necessary functions of the instrumentalist's left hand technique.

It is another object of the present invention to have the percussion attachment 10 attached in an area of the bowed stringed instrument 100 that will offer the most natural, efficient, and easiest access for the instrumentalist to strike the attachment 10 with the stick of the bow 102 with the greatest technical speed. Having the percussion attachment 10 attached to the upper left bout area 104 on the violin and viola, and the upper right bout area (not shown) of the cello and double bass, offers the most efficient opportunity for the instrumentalist to best control the desired percussive rhythms that the player wishes to produce with the stick of the bow 102. The most advanced and intricately technical rhythmic possibilities, such as ricocheting and/or scraping the bow stick 102 against the percussion attachment 10 can be successfully accomplished by the instrumentalist if the percussion attachment 10 is attached to the aforementioned areas of the bowed stringed instruments.

It is another object of the present invention to provide a percussion attachment 10 for left-handed bowed stringed instruments/players. There are bowed stringed instrumentalists who rehearse, record, and perform on left-handed bowed stringed instruments. In the case of a left-handed violin and viola, the percussion attachment 10 will be attached to the upper right bout. In the case of a left-handed cello and double bass, the percussion attachment 10 will be attached to the upper left bout. However, the percussion attachment 10 is not interchangeable from a standard right-handed bowed stringed instrument over to a left-handed bowed stringed instrument due to the fact that the asymmetric two hump design will necessarily be reversed, potentially causing technical difficulties for the player to execute bow stick ricochets. To remedy this problem, a left-handed percussion attachment 10 for a left-handed bowed stringed instrument should be constructed. All of the percussive possibilities, intended functions, technical approaches by the instrumentalist, and the intended protection that the left-handed bowed stringed instrument percussion attachment 10 provides is exactly the same as a standard right-handed percussion attachment 10.

Figure 3:
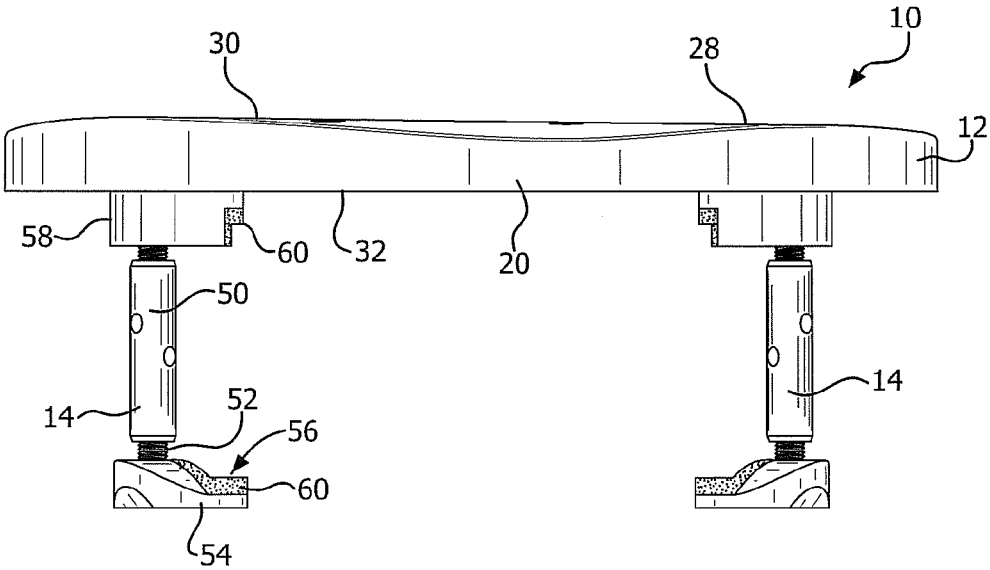
FIG. 3 is rear view of the Rhythm Beating Attachment of FIG. 1.

It is another object of the present invention to provide minimal points of surface contact to the bowed stringed instrument 100 while the percussion attachment 10 is attached to the instrument 100 so that the normal sound vibrations produced by the instrument 100 while being played upon in the traditional manner, are not stopped or muted to a considerable degree. As with any accessory, which is attached to a bowed stringed instrument, such as a chin rest and a shoulder rest, there will be some minute interference of the natural vibrations of the hollow acoustical chamber of an acoustic bowed stringed instrument. The most sound friendly clamps to attach to a bowed stringed instrument 100 upon which the percussion attachment 10 is mounted are known as "Hill style" clamps 14, developed by the famous instrument dealing firm, Hill & Sons, in London, England close to a century ago. The Hill style clamp 14 is commonly used to secure a chinrest to a violin and viola. As best seen in FIGS. 1, 3, and 10, the Hill style clamp 14 is an "L"-shaped bracket 50 with rotating barrel screws 52. Once the percussion attachment 10 is placed over the top edge of the upper left bout 104 plate for a violin and viola, or the top edge of the upper right bout (not shown) plate for cello and double bass, the barrel screws 52 are rotated so that the lower arm 54 of the clamp 14 extends below the sound chamber and the small "L" surface 56 of the clamp 14 is placed in contact with the edge of the bottom back plate. The clamp or bracket 14 applies a force to bottom edge of the sound chamber thereby securing the clamp 14 against the top edge of the bowed stringed instrument 100. Unlike the lower body surfaces of most chin rests attached to violins and violas, the body of the percussion attachment 10 does not touch or come into contact with the edge of the violin and/or viola. Neither does the body of the percussion attachment 10 come into contact with the edge of a cello and/or double bass. This is due to the fact that the body of the percussion attachment 10 is directly mounted via two, 2 millimeter by ¼-inch flat-head screws onto the top of the Hill style clamp. It should be recognized that other clamps and/or mounts are also suitable and fall within the scope of the present invention.

There are two Hill style "L"-shaped clamps 14 used to attach to the sound chamber of the bowed stringed instrument 100, and at the top of each one of these clamps, there are two pre-drilled holes in its hardware in which two steel or brass flat-head wood screws fit through the holes, which are screwed directly into the two pre-drilled holes of the non-hollowed-out underbelly surface 32 of the percussion attachment 10, thus solidly securing the body 12 of the attachment 10 to the top 58 of the clamps 14. Accordingly, this method of construction gives the body of the percussion attachment 10 an optically levitating appearance when it is attached to the sound chamber of the bowed stringed instrument 100; the greatest benefit being that the body 12 of the percussion attachment 10 does not touch the instrument while in use. Only the two Hill style clamps 14, upon which the percussion attachment 10 is mounted, come into direct contact with the sound chamber of the bowed stringed instrument 100; allowing the least amount of interference to the natural sound vibrations of the instrument. There are only four very small surface points of contact when the percussion attachment 10 is attached to the sound chamber of a bowed stringed instrument 100, of which the Hill style clamps 14 are solely responsible. While there are only four very small surface points of the Hill style clamps 14 that come into contact with the bowed stringed instrument 100 while the percussion attachment is attached to the instrument, an important embodiment of the present invention is that these four small surfaces have a non-scratch surface 60 to prevent the percussion attachment 10 from scratching or otherwise marking or damaging the instrument 100. The standard material used to cover the two inside feet of the "L"-shaped Hill style brackets or clamps 14 is cork. However, any combination of durable, yet soft, materials are also suitable for use, such as rubber, silicon, urethane, felt, leather, or other material composite that is sufficiently soft enough not to mark the edge of the bowed stringed instrument 100 while the percussion attachment 10 is being intentionally struck with the bow stick 102 by the instrumentalist. In such embodiments, any of the aforementioned materials may be glued or otherwise secured to the inside "L"-shaped feet surfaces of the Hill style clamps 14.

It is another object of the present invention to help improve the overall elegant appearance of a bowed stringed instrument 100 while the percussion attachment 10 is attached to the instrument. It is customarily known that fine bowed stringed instruments have been highly esteemed for centuries as very beautiful and valuable works of art. The percussion attachment 10 is not only designed to complement the natural dimensions of a bowed stringed instrument 100, but the materials, types of wood, colors of stain, and the like, used in the construction of the percussion attachment 10 are uniquely selected and hand crafted in such a manner that the appearance of the attachment 10 adds to the overall aesthetic appearance of the instrument 100 to which it is attached. It is the hope of the inventor that the percussion attachment 10 will be considered a valuable and important musical instrument in and of itself, unique to a bowed stringed instrument 100, and avoid being considered simply as an accessory, as one would refer to a chin rest, tail piece, tuning pegs, and the like.

It is another object of the present invention to prevent a bow 102 from striking and/or scraping the upper left bout area 104 of a violin and viola, and from striking the upper right bout area (not shown) of a cello and double bass. The greatest risk of damage is due to intentional striking of the edge of the top plate with the bow stick 102 to produce percussion in the areas aforementioned for bowed stringed instruments 100. As an equally important embodiment, the percussion attachment 10 also functions as an important protector of the area of the bowed stringed instrument 100 where the instrumentalist will be intentionally striking and/or scraping the attachment 10 for musical percussive purposes with the stick of the bow 102. The percussion attachment 10 substantially eliminates potential harm to the instrument sound chamber, such as splintering of the wood, cracks, scratches, nicks, dents, and the like to the edge of the instrument 100 due to intentional light-to-hard and slow to fast bow strikes and/or scrapes performed by the instrumentalist. The percussion attachment 10 is dimensioned as an elongated half-oval shape so as to, when installed on the bowed stringed instrument 100, cover most of the upper left bout edge of a violin and viola, and cover most of the upper right bout edge (not shown) of a cello and double bass. The reverse is true for left handed bow stringed instruments. In addition, the percussion attachment 10 is mounted onto the top of the two Hill style clamps in an intentional way so as to provide a slight, extended overhang of the body of the attachment's outer curved edge, protruding slightly over the edge of the upper left bouts of a violin and viola, and upper right bouts of a cello and double bass. This intentional overhang further ensures that the edges of bowed stringed instruments are protected by the percussion attachment 10 from potential damage caused by intentional strikes and/or scrapes executed by instrumentalists with the stick of a bow. The overhang of the percussion attachment 10 generally extends approximately 5 millimeters over the edge of the bowed stringed instrument, but this may vary. The slight overhang of the percussion attachment 10 does not interfere with the bowed stringed instrument being successfully stored into a form fitting case.

The significance of the present invention is that the percussion attachment 10 will enable bowed stringed instruments 100 to safely become, in part, percussive instruments as well. The attachment 10 will aid in redefining the acoustical possibilities of a bowed stringed instrument 100. The attachment 10 will enable an instrumentalist to explore new and innovative percussive sounds along with intricate percussive rhythms, incorporating all levels of volume never before possible on a bowed stringed instrument without the inevitably of severely damaging the instrument. In addition, when the instrumentalist intentionally strikes and/or scrapes the percussion attachment 10 with the bow stick 102, it produces various distinct percussive sounds that are unique to bowed stringed instruments that no other percussive instrument can currently reproduce. For example, the release of percussive sound waves from the percussion attachment 10 vibrating directly into the sound chamber of a bowed stringed instrument 100 can cause the four open strings of the instrument 100 to simultaneously vibrate and produce ringing overtone sounds as well. If an instrumentalist were to apply traditional left hand finger stops to the open strings while the percussion attachment 10 is intentionally being struck and/or scraped with the bow stick 102, the resulting simultaneous sounds produced in combination could theoretically be defined as "bow block string chording." Currently, there is no such definition of this unique type of sound in music history or music theory being taught in music academia anywhere in the world. The inventor foresees future Treatises being written not only on the limitless wealth of percussive sounds produced on a bowed stringed instrument 100 when utilizing the percussion attachment 10, but also on the endless possibilities of inventing new innovations in bowed stringed instrument technical know-how and pedagogy. With the advent of this percussion attachment 10, no longer will bowed stringed instruments be recognized by the public as simply a two dimensional instrument, being primarily bowed and plucked (pizzicato). By adding a truly unique and never before invented percussion dimension to the bowed stringed instrument 100, eliminating almost entirely the probability of damaging the instrument, an exciting new third dimension both in compositional opportunities and technical development of the instrument has been born.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims. For example, the present invention may, in the future, be electronically modified in order to amplify further the percussion sounds produced by the percussion attachment 10. Any such electronic addition to the percussion attachment 10 such as having an electrical chord attached to the body of the attachment 10, connected to a jack, DI chord, or any other electrical chord, including but not limited to any type of wireless device, in order to have the percussion sounds picked up by electrical frequencies and released through electrical speakers and/or monitors, are hereby claimed within the spirit and scope of the present invention as defined by the appended claims. In addition, any and all other percussive attachments directly attached to the percussion attachment 10 such as bells, chimes, and the like, are hereby claimed within the spirit and scope of the present invention.

What is claimed is:

1. A percussion attachment for a musical instrument, comprising:

a body, the body having at least one aerating hole formed therein;

at least one clamp mounted to the body that attaches the body to the musical instrument, wherein the body may be struck and/or scraped by the stick of a bow to produce percussion as well as functioning simultaneously as a protector as the musical instrument is being played.

2. The percussion attachment according to claim 1 wherein the body has an outer top surface that has a convex shape.

3. The percussion attachment according to claim 2 wherein the top surface has a hump formed at either end.

4. The percussion attachment according to claim 1 wherein the at least one clamp is a pair of Hill-style clamps.

5. The percussion attachment according to claim 1 wherein the at least one clamp detachably secures the attachment to the musical instrument.

6. The percussion attachment according to claim 1 wherein the attachment has a carved-out incrementally sloped design that is acoustically designed to produce enhanced and amplified percussive sounds when struck with the stick of the bow.

7. The percussion attachment according to claim 1 wherein the body further comprises ornamentation.

8. The percussion attachment according to claim 1 wherein the body is made from wood, metal, or plastic.

9. The percussion attachment according to claim 1 wherein the body further comprises ribs that are spaced along an outermost curved edge of the body.

10. The percussion attachment according to claim 1 wherein the body further comprises pits spaced on a top surface of the body.

11. The percussion attachment according to claim 9 wherein the body further comprises pits spaced on a top surface of the body.

12. The percussion attachment according to claim 11 wherein the ribs are crescent-moon-shaped and the pits are cone-shaped.

13. A method for producing percussion sounds, comprising:

providing a musical instrument;

providing an attachment comprising a body, the body having at least one aerating hole formed therein, and at least one clamp mounted to the body fixture for attaching the body to the musical instrument;

securing the attachment to the musical instrument;

contacting the attachment with the stick of a bow to produce a percussion sound.

14. The method according to claim 13 wherein the body further comprises ribs that are spaced along an outermost curved edge of the body and further comprising contacting the ribs with the stick of a bow to produce a percussion sound.

15. The method according to claim 13 wherein the body further comprises pits spaced on a top surface of the body and further comprising contacting the pits with the stick of a bow to produce a percussion sound.

* * * * *